US011292045B2

(12) United States Patent
Zhao et al.

(10) Patent No.: US 11,292,045 B2
(45) Date of Patent: Apr. 5, 2022

(54) FULL-ELECTRIC SERVO VERTICAL THREE-COUNTER-ROLLER DRIVING POWER SPINNING DEVICE

(71) Applicant: Xi'an Jiaotong University, Xi'an (CN)

(72) Inventors: Shengdun Zhao, Xi'an (CN); Fan Li, Xi'an (CN); Chengcheng Zhu, Xi'an (CN); Shuqin Fan, Xi'an (CN); Hong Jiang, Xi'an (CN)

(73) Assignee: Xi'an Jiaotong University, Xi'an (CN)

( * ) Notice: Subject to any disclaimer, the term of this patent is extended or adjusted under 35 U.S.C. 154(b) by 91 days.

(21) Appl. No.: 16/929,127

(22) Filed: Jul. 15, 2020

(65) Prior Publication Data

US 2021/0023602 A1 Jan. 28, 2021

(30) Foreign Application Priority Data

Jul. 22, 2019 (CN) ..... 201910662560.6

(51) Int. Cl.

| | |
|---|---|
| ***B21D 22/16*** | (2006.01) |
| ***B21D 22/14*** | (2006.01) |
| ***B21D 41/02*** | (2006.01) |
| ***B21D 22/18*** | (2006.01) |

(52) U.S. Cl.

CPC ..... *B21D 22/16* (2013.01); *B21D 22/14* (2013.01); *B21D 22/18* (2013.01); *B21D 41/026* (2013.01)

(58) Field of Classification Search

CPC ..... B21D 22/16; B21D 22/18; B21D 22/14; B21D 41/026

See application file for complete search history.

(56) References Cited

FOREIGN PATENT DOCUMENTS

| | | | |
|---|---|---|---|
| CN | 201385079 Y | | 1/2010 |
| CN | 105458057 A | | 4/2016 |
| CN | 106270084 A | * | 1/2017 |
| CN | 106270084 A | | 1/2017 |
| GB | 936826 A | | 9/1963 |
| GB | 2184676 B | | 5/1989 |

OTHER PUBLICATIONS

Machine Translation for CN-106270084-A (Year: 2017).*

* cited by examiner

*Primary Examiner* — Christopher J Besler
*Assistant Examiner* — Christine Bersabal
(74) *Attorney, Agent, or Firm* — Bayramoglu Law Offices LLC

(57) ABSTRACT

A full-electric servo vertical three-counter driving power spinning device includes a rack, and the rack includes a baseplate. A workpiece active rotating mechanism and an inner roller feeding mechanism are provided on the baseplate, an outer roller feeding mechanism is provided on the rack; the outer roller feeding mechanism is provided with an outer roller active rotating mechanism; the outer roller active rotating mechanism includes an outer roller active rotating motor and an outer roller, and the inner roller feeding mechanism includes an inner roller. A stress state of a cylinder material by adopting a combined method of an active rotation of a roller and an active rotation of a workpiece turntable is significantly different from that by a passive spinning of a counter-roller, thus improving a thinning rate of a wall thickness of a cylindrical member and a hardening properties of materials.

5 Claims, 6 Drawing Sheets

FULL-ELECTRIC SERVO VERTICAL THREE-COUNTER-ROLLER DRIVING POWER SPINNING DEVICE

CROSS REFERENCES TO THE RELATED APPLICATIONS

This application is based upon and claims priority to Chinese Patent Application No. 201910662560.6, filed on Jul. 22, 2019, the entire contents of which are incorporated herein by reference.

TECHNICAL FIELD

The present invention relates to the field of spinning processing, and in particular relates to a full-electric servo vertical three counter-roller driving power spinning device.

BACKGROUND

The large-size and high-strength metal thin-walled cylindrical parts used for heavy rockets include core-level body of rocket's engine, fuel storage tanks, and thruster engine casings etc. These large-size thin-walled cylinders have considerable difficulties in processing.

At present, the traditional processing technology for large-diameter thin-walled cylinders mainly includes plate coil welding and mandrel spinning and so on.

Plate coil welding is a simple and efficient solution for manufacturing large-diameter thin-walled cylinder. However, the material properties and stress state of the welding lines of coil-welded cylinder are still inferior to the base materials. Moreover, the local thermal deformation caused by welding seriously affects the dimensional accuracy and surface quality of the workpiece.

Mandrel spinning is a common technology for manufacturing seamless cylinder, which has outstanding advantages in forming cylinder parts with thin walls, light weight, high strength and high precision. In the traditional mandrel spinning system, the inner surface of the blank is close to the mandrel and the end of the blank is against the shoulder of the mandrel. When the blank and mandrel rotate with the spindle, the rotary wheel maintains a given distance from the mother line of mandrel, and feeds in parallel to the axis of the mandrel to squeeze the blank gradually, in order to form the cylinder.

The counter-roller power spinning is developed from the mandrel spinning. The inner roller is used instead of the mandrel to process the inner and outer surfaces of the cylinder workpiece at the same time. For the counter-roller spinning, the position of the spinning roller can be adjusted according to the size of a workpiece, so as to realize the flexible processing of cylindrical parts with different diameters and wall thicknesses.

When these two processes are applied to the processing of large-size and thin-walled cylinders, some disadvantages arise:

(1) If the traditional mandrel spinning method is adopted for one piece or very small batch of large-size and thin-walled cylinder of large rocket engine, there are many defects such as poor flexibility, high cost, inconsistent surface performance of the inner and outer layers, difficult and time-consuming workpiece loading and unloading, etc.;

(2) The height of the large-diameter thin-walled cylinder is large, and the torsional rigidity of the cylinder wall is low. If the traditional counter-roller spinning method in which the cylinder is separately rotated by the power source at the bottom of the cylinder is adopted, the buckling deformation and huge torsional elastic deformation are easily caused in the cylinder wall by the large torque and large spinning force of the power spinning, resulting in limited wall thickness reduction rate and reduced production efficiency in a single power rotation. In addition, the accuracy of the size of the cylinder wall during power rotation cannot be guaranteed due to the torsional elastic deformation of the cylinder wall.

SUMMARY

In order to solve the above problems in the background art, the present invention proposes a full-electric servo vertical three counter-roller driving power spinning device. The stress state of the cylinder material at the spinning part by adopting a combined method of active rotation of the roller and active rotation of the workpiece turntable is significantly different from that by the passive counter-roller spinning, thus improving the thinning rate of the wall thickness of the cylindrical workpiece and improving hardening properties of materials.

A full-electric servo vertical three counter-roller driving power spinning device is provided as the technical solution for solving the above problems of the present invention, including: a rack including a baseplate, a workpiece active rotating mechanism and an inner roller feeding mechanism are provided on the baseplate, an outer roller feeding mechanism is provided on the rack; the outer roller feeding mechanism is provided with the outer roller active rotating mechanism; the outer roller active rotating mechanism includes an outer roller active rotating motor and an outer roller, and the inner roller feeding mechanism includes an inner roller.

Wherein the workpiece active rotating mechanism is used to clamp and rotate the cylinder workpiece to be processed; the outer roller feeding mechanism can cause the outer roller to move in the axial and radial directions of the cylinder workpiece, the outer roller active rotating motor drives the outer roller to rotate; the inner roller feeding mechanism can cause the inner roller to move in the axial and radial directions of the cylinder workpiece, the outer roller and the inner roller cooperate to realize the spinning processing of the cylinder workpiece to be processed.

Furthermore, the outer roller feeding mechanism includes an outer roller radial feeding mechanism and an outer roller axial feeding mechanism.

The outer roller axial feeding mechanism includes a moving beam, a pillar, a first screw and a first servo motor; the number of the moving beam is three; the moving beam is parallel to the baseplate of the rack, and the two ends of the moving beam are respectively connected to one side plate; the three moving beams form a triangle, and the outward end surfaces of the side plates at both ends of the two adjacent moving beams are connected by a stop, and the upper end surfaces of the side plates at both ends of two adjacent moving beams are connected by a reinforcement plate; a screw nut is installed in the center of the moving beam, and the screw nut is connected to the first screw which is perpendicular to the moving beam; the bottom of the first screw is fixed to the baseplate and connected to the first servo motor, the top of the first screw is fixedly connected to the rack; guide sleeves are fixedly installed on both sides of the screw nut on the moving beam; the guide sleeves cooperate with the pillar which is perpendicular to the moving beam, one end of the pillar is fixed on the baseplate, and the other end is fixed on the rack.

The outer roller radial feeding mechanism includes a second servo motor, a second screw, a guide rail, an outer roller seat; the side plate is provided with a guide rail on the other side, the guide rail is provided with a slider fixedly connected with the outer roller seat; the axis of the second screw is parallel or located on the plane where the moving beam is located; one end of the outer roller seat is provided with an outer roller, and the other end is provided with a screw nut and is connected with the second screw, and the end of the second screw is fixed at the stop and connected with the second servo motor.

Furthermore, the inner roller feeding mechanism includes an inner roller pillar, an inner roller top plate, an inner roller upper plate, an inner roller lower plate, a third screw and a third servo motor.

The number of the inner roller pillar is three, the inner roller pillar is perpendicular to the baseplate, one end of the inner roller pillar is fixed on the baseplate, and the other end is fixedly connected to the inner roller top plate, and the middle section of the inner roller pillar is respectively connected to the inner roller upper plate and the inner roller lower plate through guide sleeves; three inner roller shafts are installed between the inner roller upper plate and the inner roller lower plate, the inner roller is installed on the inner roller shaft, each of the inner roller upper plate and the inner roller lower plate is provided with U-shaped grooves, the inner roller shaft can slide in the U-shaped grooves of the inner roller upper plate and the inner roller lower plate; each end of the U-shaped groove of the inner roller upper plate and the inner roller lower plate is provided with a barrier, which can prevent the inner roller shaft from sliding out of the U-shaped grooves; the inner roller upper plate and the inner roller lower plate are equipped with three identical stud bolts at both ends to prevent the inner roller upper plate and the inner roller lower plate moving; and a cam mounting cylinder is installed between the inner roller upper plate and the inner roller lower plate, the bottom of the cam mounting cylinder is inserted into the inner roller lower plate and can rotate around its own axis, the upper part of the cam mounting cylinder passes through the inner roller upper plate and is connected with the worm gear by a flat key, the cam mounting cylinder is connected with two cams via a flat key respectively at the positions that are close to the inner roller upper plate and the inner roller lower plate; the convex surface of the cam is tangent to the inner roller shaft; two identical worm seats are installed on the inner roller upper plate, and two identical worm seats are respectively connected to both ends of the worm, with one end of the worm being provided with a synchronous pulley which is connected to the pulley at the shaft end of brake motor through the synchronous belt; the worm is engaged with the worm gear, and the worm gear is fixedly mounted on the cam mounting cylinder by a flat key; the inner roller lower plate is connected to the third screw by a screw nut, the bottom of the third screw is fixed on the baseplate and connected to the third servo motor.

Moreover, the workpiece active rotating mechanism includes a fourth servo motor, a pinion gear, large gear turntable and roller; the roller is mounted on the baseplate by bearings and its shaft so that it can rotate around its own axis; the fourth servo motor is installed on the baseplate by a speed reducer, the output shaft of the speed reducer is fixedly installed with a pinion gear, the pinion gear is engaged with the large gear turntable, the bottom of the large gear turntable is mounted on the flange of the roller, the upper surface of the large gear turntable is provided with T-shaped groove; the top of the large gear turntable is mounted with a cylindrical workpiece, and the bottom of the cylindrical workpiece is fixed on the T-shaped groove of the large gear turntable by screws.

Further, the rack includes an upper beam, the top of the pillar is connected with the upper beam by a lock nut, a cover plate is installed on the top of the upper beam, and the inner roller top plate is connected with the upper beam by the cover plate; three nitrogen balance cylinders are installed on the upper beam, and the end of the piston rod of the nitrogen balance cylinder is connected with the reinforcement plate for balancing the dead-weight of the outer roller feeding mechanism.

Advantages of the invention are as follows:

(1) The features, such as vertical placement of the workpiece, the rotation and radial feeding of the inner and outer rollers driven by respective servo motors, overcome the defect that the processing length of the cantilever at the end of the existing roller rack is limited. The spinning height of the novel device according to present invention is significantly larger than that of the existing spinning cylinder, which improves the processing range of the cylindrical member in the height direction. In addition, the deformation of the inner and outer surfaces of the workpiece is consistent. And the driving of the full-electric servo motor greatly improves the machining accuracy of the inner and outer surface of the workpiece; and (2) The stress state of the cylinder material at the spinning part by adopting a combined method of active rotation of the roller and active rotation of the workpiece turntable is significantly different from that by the passive spinning of counter-roller, which improves the thinning rate of the wall thickness of the cylindrical member and improves hardening properties of materials.

LIST OF REFERENCE NUMBER

Figure 1:
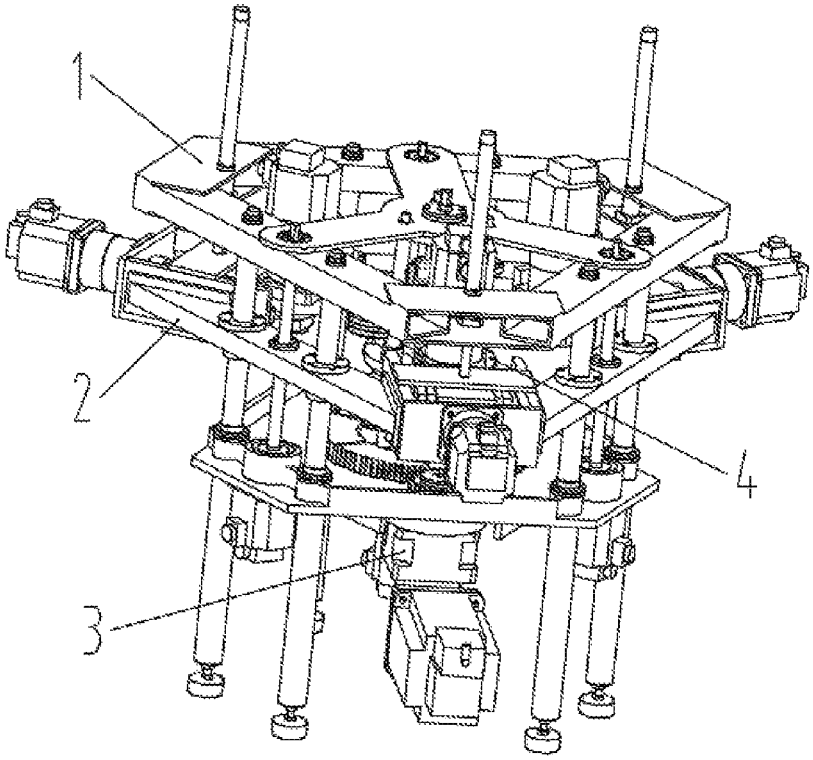
FIG. 1 is a schematic structural diagram of the full-electric servo vertical three counter-roller driving power spinning device of the present invention.
Figure 2:
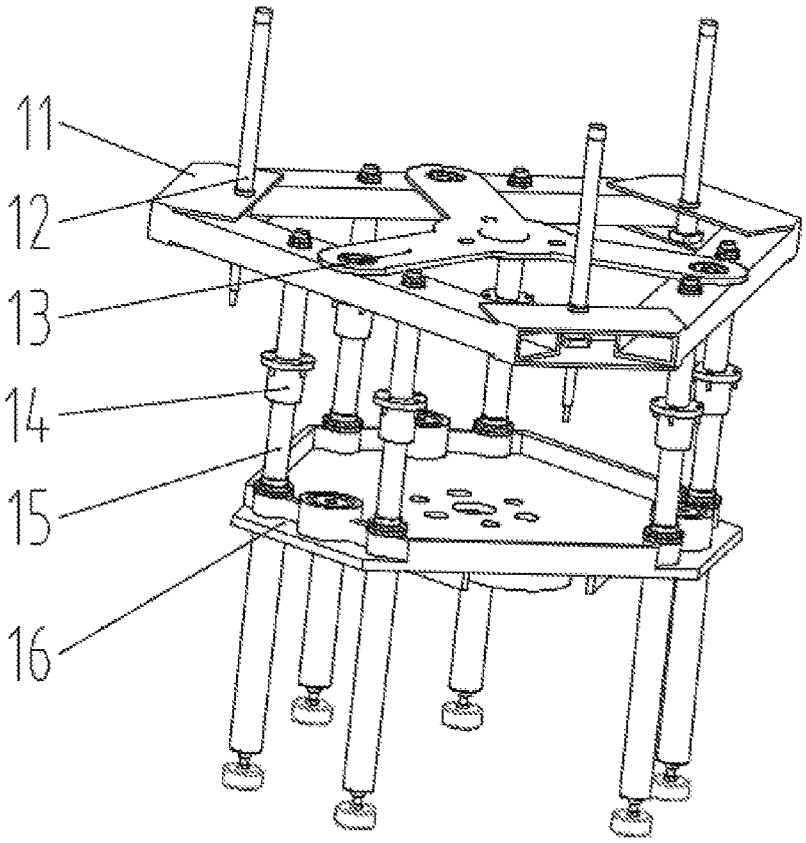
FIG. 2 is a schematic structural diagram of a rack of the full-electric servo vertical three counter-roller driving power spinning device of the present invention.
Figure 3:
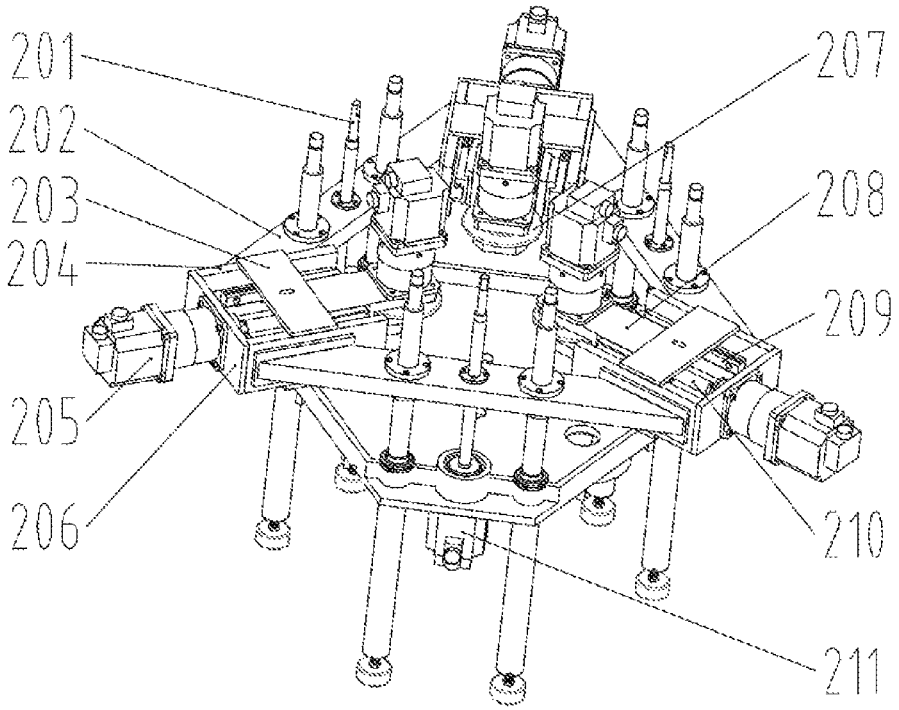
FIG. 3 is a schematic diagram of the outer roller feeding mechanism of the present invention.
Figure 4:
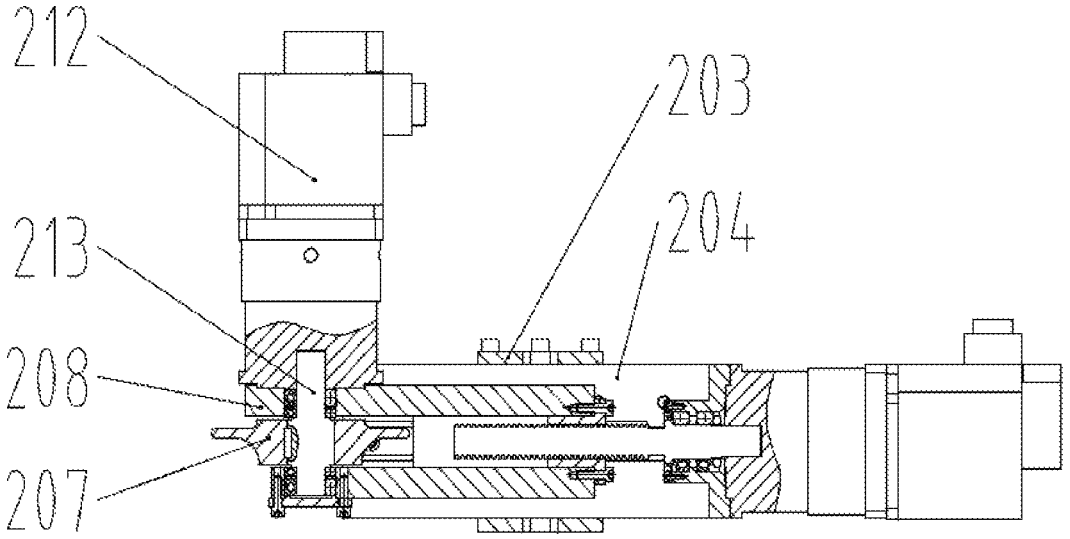
FIG. 4 is a cross-sectional view of the outer roller active rotating mechanism of the present invention.
Figure 5:
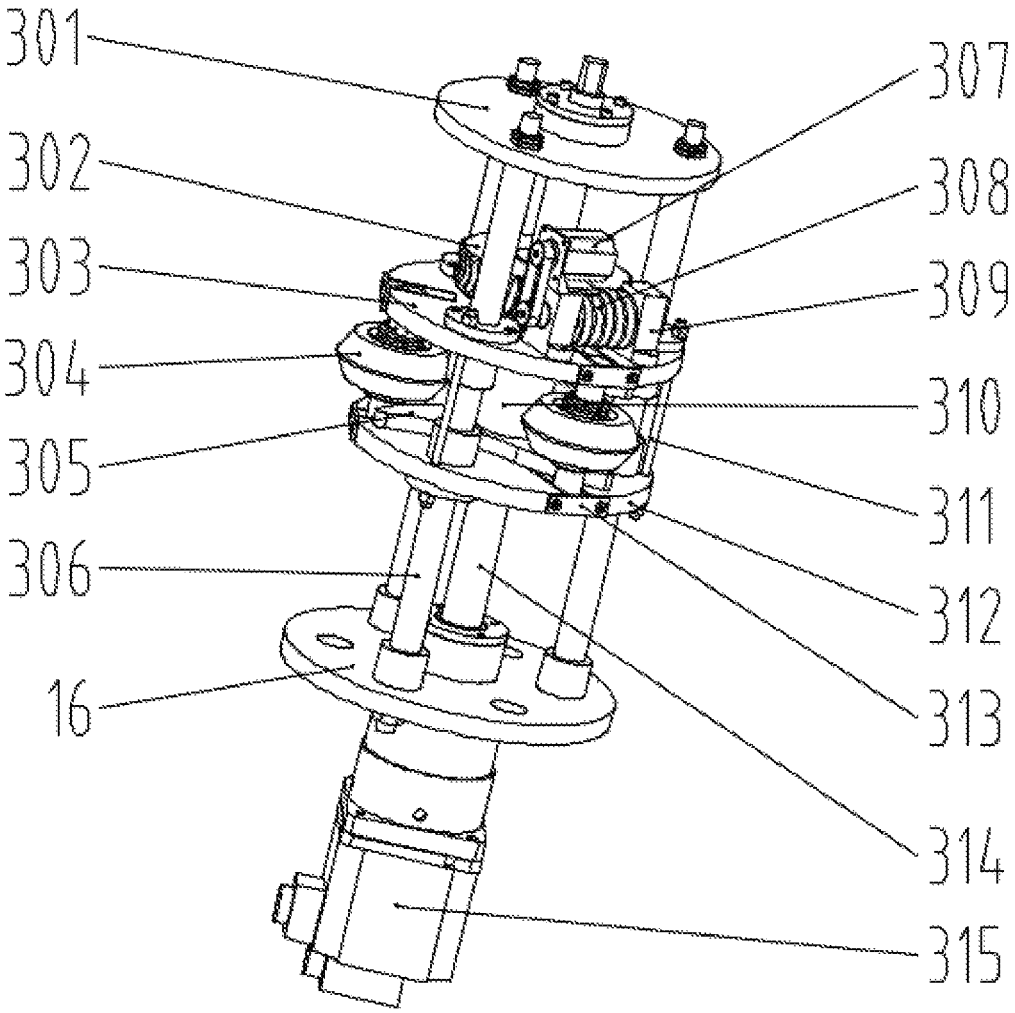
FIG. 5 is a schematic structure diagram of the inner roller feeding mechanism of the present invention.
Figure 6:
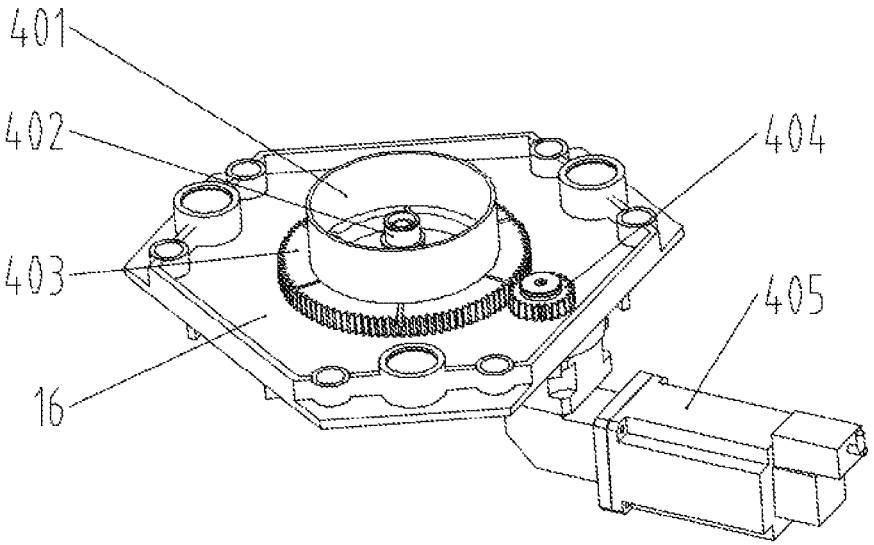
FIG. 6 is a schematic diagram of the workpiece active rotating structure of the present invention.

1—rack, 2—outer roller feeding mechanism, 3—workpiece active rotating mechanism, 4—inner roller feeding mechanism, 11—upper beam, 12—nitrogen balance cylinder, 13—cover plate, 14—guide sleeve, 15—pillar, 16—baseplate, 201—the first screw, 202—moving beam, 203—reinforcement plate, 204—side plate, 205—the second servo motor, 206—stop, 207—outer roller, 208—outer roller seat, 209—guide rail, 210—the second screw, 211— the first servo motor, 212—outer roller active rotating motor, 213—outer roller shaft, 301—inner roller top plate, 302—worm gear, 303—inner roller upper plate, 304—inner roller, 305—cam, 306—inner roller pillar 307—brake motor, 308—worm, 309—worm seat, 310—cam mounting cylinder, 311—stud bolt, 312—inner roller lower plate, 313—barrier, 314—the third screw, 315—the third servo motor, 401—cylinder workpiece, 402—roller, 403—large gear turntable, 404—pinion gear, 405—the fourth servo motor.

DETAILED DESCRIPTION OF THE EMBODIMENTS

In order to make objectives, technical solutions, and advantages of embodiments of the present invention clearer, the technical solutions in the embodiments of the present invention are described clearly and completely in the following with reference to accompanying drawings in the embodiments of the present invention. Apparently, the described embodiments are only part rather than all of the embodiments of the present invention. All other embodiments obtained by persons of ordinary skill in the art based on the embodiments of the present invention without creative efforts shall fall within the protection scope of the present invention. Therefore, the detailed descriptions about the embodiments of the present invention in the accompanying drawings are not intended to limit the protection scope, and are merely selected embodiments of the invention. All other embodiments obtained by persons of ordinary skill in the art based on the embodiments of the present invention without creative efforts shall fall within the protection scope of the present invention.

Referring to FIGS. 1 to 6, a full-electric servo vertical three counter-roller driving power spinning device includes a rack 1 having baseplate 16, a workpiece active rotating mechanism 3 and an inner roller feeding mechanism 4 are provided on the baseplate 16. And an outer roller feeding mechanism 2 is also provided on the rack 1.

The rack 1 includes a triangular star-shaped baseplate 16, on which a mounting base for pillar 15 is provided connecting to six identical pillars 15. A guide sleeve 14 is installed in the middle section of the pillar 15 for connecting the moving beam 202. The top of pillar 15 is connected to the upper beam 11 through a lock nut.

The outer roller feeding mechanism 2 includes three groups of the same moving beams 202. A screw nut is installed in the center of the moving beam 202 and is connected with the first screw 201. The bottom of the first screw 201 is fixed on the baseplate 16 and connected to the first servo motor 211. The top of the first screw 201 and the upper beam 11 are connected and fixed by nuts. There are two guide sleeves 14 fixedly installed on the moving beam 202, and the two guide sleeves 14 are respectively installed on the pillar 15. The end of the moving beam 202 is connected to one side of the side plate 204. The ends of the two side plates 204 are connected to the stop 206 to form a U-shaped frame, and the tops of the two side plates 204 are connected by reinforcement plate 203. The other side of the side plate 204 is provided with a guide rail 209, on which a slider fixedly connected to the outer roller seat 208 is installed. One end of the outer roller seat 208 is provided with an outer roller 207, and the other end is provided with a screw nut and connected to the second screw 210. The end of the second screw 210 is fixed to the stop 206 and connected to the second servo motor 205.

The outer roller active rotating mechanism 2 includes an outer roller seat 208. An outer roller shaft 213 is fixedly installed at one end of the outer roller seat 208 via bearings, and the outer roller shaft 213 is connected with the outer roller 207 by a key. The top of the outer roller shaft 213 is connected to the outer roller active rotating motor 212.

Three nitrogen balance cylinders 12 are installed on the upper beam 11. The end of the piston rod of the nitrogen balance cylinder 12 is connected to the reinforcement plate 203 for balancing the dead-weight of the outer roller feeding mechanism. The top of the upper beam 11 is provided with a cover plate 13.

Figure 7:
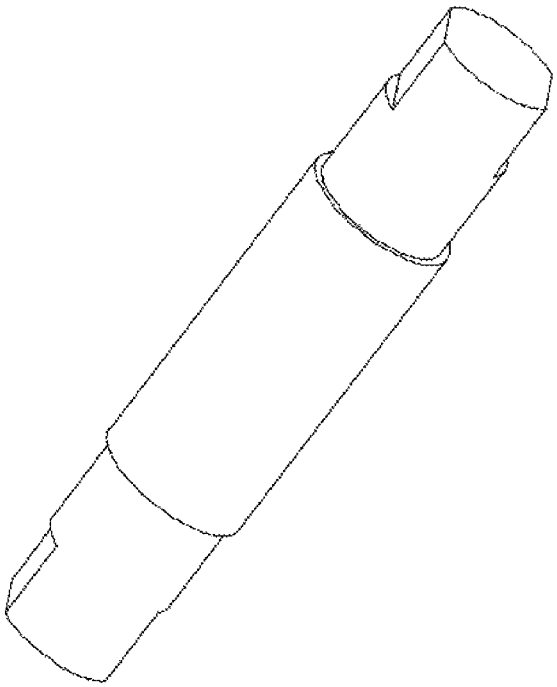
FIG. 7 is a structural view of the inner roller shaft of the present invention.

The inner roller feeding mechanism 4 includes three identical inner roller pillars 306, the bottom of inner roller pillars 306 is fixedly connected to the baseplate 16, and the top of inner roller pillars 306 is fixedly connected to the inner roller top plate 301. The middle section of the inner roller pillar 306 is connected to the inner roller upper plate 303 and the inner roller lower plate 312 by the guide sleeve 14 respectively. An inner roller shaft is installed between the inner roller upper plate 303 and the inner roller lower plate 312 and can slide in the U-shaped groove of the inner roller upper plate 303 and the inner roller lower plate 312. Each end of the U-shaped groove of the inner roller upper plate 303 and the inner roller lower plate 312 is provided with a barrier 313, which can prevent the inner roller shaft from sliding out of the U-shaped groove. Referring to FIG. 7, two right-angle bosses are cut out at the ends of the inner roller shaft. The surface of the boss of the inner roller shaft contacts with the U-shaped groove, with the shoulders of the surface of the boss supported against the inner roller upper plate 303 and the inner roller lower plate 312 respectively, in order to ensure that the inner roller shaft is always perpendicular to the inner roller upper plate 303 and the inner roller lower plate 312.

Figure 8:
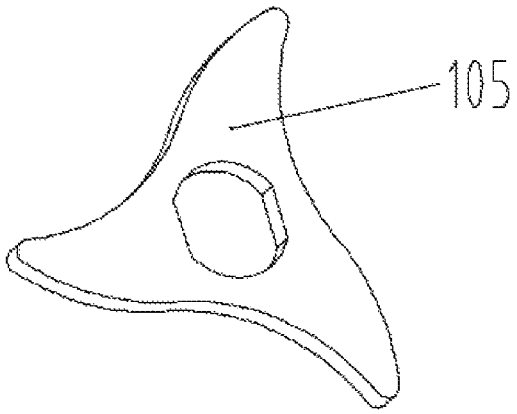
FIG. 8 is a structural diagram of the cam of the present invention.
Figure 9:
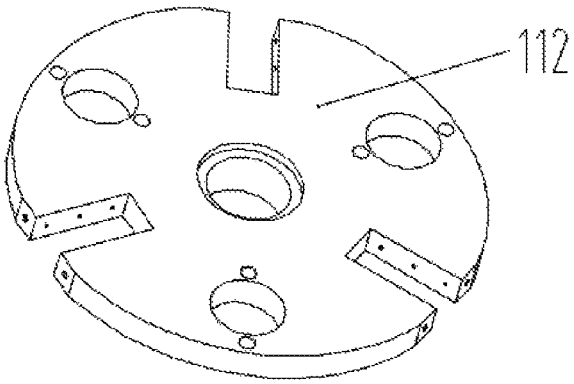
FIG. 9 is a structural view of the inner roller upper plate of the present invention.

The inner roller upper plate 303 (the structure of which is shown in FIG. 9) and the inner roller lower plate 312 are equipped with three identical stud bolts 311 at both ends to prevent the inner roller upper plate 303 and the inner roller lower plate 312 moving. The inner roller shaft is connected with the inner roller 304 by a bearing. A cam mounting cylinder 310 is installed between the inner roller upper plate 303 and the inner roller lower plate 312. The bottom of the cam mounting cylinder 310 is inserted into the inner roller lower plate 312 and can rotate around its own axis, and the upper part of the cam mounting cylinder 310 passes through the inner roller upper plate 303 and is connected to the worm gear 302 by a flat key. The cam mounting cylinder 310 is connected with two cams 305 (the structure of which is shown in FIG. 8) via a flat key respectively at the positions that close to the inner roller upper plate 303 and the inner roller lower plate 312. The convex surface of the cam 305 is tangent to the inner roller shaft. Two identical worm seats 309 are installed on the inner roller upper plate 303, and the two worm seats 309 are respectively connected to both ends of the worm 308, with one end of the worm 308 being provided with a synchronous pulley which is connected to the pulley at the shaft end of brake motor 307 through the synchronous belt. The worm 308 is engaged with the worm gear 302, and the worm gear 302 is fixedly mounted on the cam mounting cylinder 310 by a flat key. The inner roller lower plate 312 is connected to the third screw 314 by a screw nut, the bottom of the third screw 314 is fixed on the baseplate 16 and connected to the third servo motor 315.

The workpiece active rotating mechanism 3 includes the fourth servo motor 405, which is mounted on the baseplate 16 by a speed reducer. The output shaft of the speed reducer is fixedly installed with a pinion gear 404, pinion gear 404 is engaged with the large gear turntable 403. The bottom of the large gear turntable 403 is mounted on the flange of the roller 402. The roller 402 is mounted on the floor by bearings and its shaft so that it can rotate around its own axis. The top of the large gear turntable 403 is mounted with a cylinder workpiece, and the bottom of cylinder workpiece 401 is fixed on the T-shaped groove of the large gear turntable 403 by screws.

In the present invention, the three outer rollers 207 are arranged in a triangular star shape, and their radial motions are respectively driven by three servo motors via screw nuts, while their axial motions are respectively driven by three servo motors via screw nuts along with moving beam 202. A group of servo motors and speed reducers are installed on the outer roller shaft 213 to make the outer roller 207 rotates actively. The inner roller structure is mounted on the baseplate 16 through three inner roller pillars 306. The axial movement of the inner roller 304 is also made by the servo motor driving the screw nut along with the inner roller lower plate 312, thus making the entire mechanism move up and down. The radial feeding of the inner roller 304 relies on the flange of the cam 305 to push the inner roller shaft to move in the U-shaped groove. The rotation of the cam 305 is caused by the rotation of the cam mounting cylinder 310, the upper part of the cam mounting cylinder 310 is secured to the worm gear 302 by a flat key.

The above descriptions are only for the embodiments of the invention, not to limit the scope of the invention. Any equivalent structure or equivalent process transformation made by using the contents of the description and the drawings of the invention, or directly or indirectly used in other related system fields, are similarly included in the protection scope of the invention.

The invention claimed is:

1. A full-electric servo vertical three counter-roller driving power spinning device, comprising:

a rack, wherein the rack comprises a baseplate, a workpiece active rotating mechanism and an inner roller feeding mechanism are provided on the baseplate, an outer roller feeding mechanism is provided on the rack; the outer roller feeding mechanism is provided with an outer roller active rotating mechanism; the outer roller active rotating mechanism comprises an outer roller active rotating motor and an outer roller, and the inner roller feeding mechanism comprises an inner roller;

wherein the workpiece active rotating mechanism is used to clamp and rotate a cylinder workpiece to be processed; the outer roller feeding mechanism causes the outer roller to move in axial and radial directions of the cylinder workpiece, the outer roller active rotating motor drives the outer roller to rotate; the inner roller feeding mechanism causes the inner roller to move in the axial and radial directions of the cylinder workpiece, the outer roller and the inner roller cooperate to realize a spinning processing of the cylinder workpiece to be processed.

2. The full-electric servo vertical three counter-roller driving power spinning device according to claim 1, wherein the outer roller feeding mechanism comprises an outer roller radial feeding mechanism and an outer roller axial feeding mechanism;

the outer roller axial feeding mechanism comprises a plurality of moving beams, a pillar, a first screw and a first servo motor; a number of the plurality of moving beams is three; each moving beam of the plurality of moving beams is parallel to the baseplate of the rack, and two ends of the each moving beam are respectively connected to a side plate; the three moving beams form a triangle, and a plurality of outward end surfaces of the side plate at both ends of two adjacent moving beams of the three moving beams are connected by a stop, and a plurality of upper end surfaces of the side plate at the both ends of the two adjacent moving beams are connected by a reinforcement plate; a screw nut is installed in a center of the each moving beam, and the screw nut is connected to the first screw, wherein the first screw is perpendicular to the each moving beam; a bottom of the first screw is fixed to the baseplate and connected to the first servo motor, a top of the first screw is fixedly connected to the rack; a plurality of guide sleeves are fixedly installed on both sides of the screw nut on the each moving beam; a guide sleeve of the plurality of guide sleeves cooperates with the pillar, wherein the pillar is perpendicular to the each moving beam, a first end of the pillar is fixed on the baseplate, and a second end of the pillar is fixed on the rack;

the outer roller radial feeding mechanism comprises a second servo motor, a second screw, a guide rail, an outer roller seat; the side plate is provided with the guide rail on another side, the guide rail is provided with a slider fixedly connected with the outer roller seat; an axis of the second screw is parallel or located on a plane, and the each moving beam is located on the plane; a first end of the outer roller seat is provided with the outer roller, and a second end of the outer roller seat is provided with the screw nut and is connected with the second screw, and an end of the second screw is fixed at the stop and connected with the second servo motor.

3. The full-electric servo vertical three counter-roller driving power spinning device according to claim 2, wherein the inner roller feeding mechanism comprises a plurality of inner roller pillars, an inner roller top plate, an inner roller upper plate, an inner roller lower plate, a third screw and a third servo motor;

a number of the plurality of inner roller pillars is three, each inner roller pillar of the plurality of inner roller pillars is perpendicular to the baseplate, a first end of the each inner roller pillar is fixed on the baseplate, and a second end of the each inner roller pillar is fixedly connected to the inner roller top plate, and a middle section of the each inner roller pillar is respectively connected to the inner roller upper plate and the inner roller lower plate through the plurality of guide sleeves; three inner roller shafts are installed between the inner roller upper plate and the inner roller lower plate, the inner roller is installed on an inner roller shaft of the three inner roller shafts, each of the inner roller upper plate and the inner roller lower plate is provided with a plurality of U-shaped grooves, the inner roller shaft of the three inner roller shafts slides in the plurality of U-shaped grooves of the inner roller upper plate and the inner roller lower plate; and one cam mounting cylinder is installed between the inner roller upper plate and the inner roller lower plate, a bottom of the cam mounting cylinder is inserted into the inner roller lower plate and the bottom of the cam mounting cylinder rotates around an axis of the cam mounting cylinder, an upper part of the cam mounting cylinder passes through the inner roller upper plate and is connected with a worm gear by a first flat key, the cam mounting cylinder is installed with two cams via a second flat key respectively at a plurality of positions, wherein the plurality of positions are adjacent to the inner roller upper plate and the inner roller lower plate; a convex surface of a cam of the two cams is tangent to a shaft of the inner roller; two identical worm seats are installed on the inner roller upper plate, and are respectively connected to both ends of a worm, one end of the worm is provided with a synchronous pulley, wherein the synchronous pulley is connected to a pulley at a shaft end of a brake motor through a synchronous belt; the worm is engaged with the worm gear, and the worm gear is fixedly mounted on the cam mounting cylinder by the first flat key; the inner roller lower plate is connected to the third screw by the screw nut, a bottom of the third screw is fixed on the baseplate and connected to the third servo motor.

4. The full-electric servo vertical three counter-roller driving power spinning device according to claim 3, wherein the workpiece active rotating mechanism comprises a fourth servo motor, a pinion gear, a gear turntable and a roller;

the roller is mounted on the baseplate by a plurality of bearings and a shaft of the roller so that the roller rotates around an axis of the roller;

the fourth servo motor is installed on the baseplate by a speed reducer, an output shaft of the speed reducer is fixedly installed with the pinion gear, wherein the pinion gear is engaged with the gear turntable, a bottom of the gear turntable is mounted on a flange of the roller, an upper surface of the gear turntable is provided with a T-shaped groove;

a top of the gear turntable is mounted with a cylindrical workpiece, and a bottom of the cylindrical workpiece is fixed on the T-shaped groove of the gear turntable by a plurality of screws.

5. The full-electric servo vertical three counter-roller driving power spinning device according to claim 4, wherein the rack comprises an upper beam, a top of the pillar is connected with the upper beam by a lock nut, a cover plate is installed on a top of the upper beam, and the inner roller top plate is connected with the upper beam by the cover plate; three nitrogen balance cylinders are installed on the upper beam, and an end of a piston rod of each of the three nitrogen balance cylinders is connected with the reinforcement plate.

* * * * *